US005711280A

United States Patent [19]

Foerster et al.

[11] Patent Number: 5,711,280

[45] Date of Patent: Jan. 27, 1998

[54] METHOD AND APPARATUS FOR TRIGGERING AN ELECTROMAGNETIC CONSUMER

[75] Inventors: Ralf Foerster, Regensburg; Hartmut Gerken, Nittendorf; Manfred Weigl, Berg, all of Germany

[73] Assignee: Siemens Aktiengesellschaft, Munich, Germany

[21] Appl. No.: 711,095

[22] Filed: Sep. 9, 1996

[30] Foreign Application Priority Data

Sep. 7, 1995 [DE] Germany ..... 195 33 131.1

[51] Int. Cl.[6] ..... F02M 37/04

[52] U.S. Cl. ..... 123/506; 123/490; 361/152

[58] Field of Search ..... 361/152, 153, 361/154, 155; 123/458, 506, 499, 357, 490, 500, 501

[56] References Cited

U.S. PATENT DOCUMENTS

| | | | |
|---|---|---|---|
| 4,112,477 | 9/1978 | Sherwin | 361/155 |
| 4,266,261 | 5/1981 | Streit | 361/154 |
| 4,284,051 | 8/1981 | Maisch | 123/499 |
| 4,336,564 | 6/1982 | Wisniewski | 361/154 |
| 4,511,945 | 4/1985 | Nielsen | 361/152 |
| 4,536,818 | 8/1985 | Nielsen | 361/152 |
| 4,610,233 | 9/1986 | Kushida | 123/357 |
| 5,235,490 | 8/1993 | Frank | 361/152 |
| 5,293,299 | 3/1994 | Iwabuchi | 361/154 |
| 5,341,032 | 8/1994 | Brambilla | 123/490 |

FOREIGN PATENT DOCUMENTS

| | | |
|---|---|---|
| 28 28 678 | 4/1980 | Germany . |
| 35 03 286 | 8/1985 | Germany . |
| 35 07 130 | 9/1985 | Germany . |

*Primary Examiner*—Carl S. Miller

*Attorney, Agent, or Firm*—Laurence A. Greenberg; Herbert L. Lerner

[57] ABSTRACT

A method for triggering an electromagnetic consumer with low coil resistance (solenoid for a Diesel injection pump) having a free-running circuit that can be switched over, and an apparatus for performing the method, regulate a voltage at an end stage to a predetermined value. This is accomplished by controlling the control voltage of the end stage during a turn-on phase until a turn-on peak current is reached and then regulating the holding current by repeatedly lowering the current through the end stage and keeping it constant to a predetermined value during a predetermined time period and then raising it again to a maximum value of the holding current until the consumer is turned off.

7 Claims, 4 Drawing Sheets

$V_{solmax}$
$V_{dmin+}$
$V_{dmin-}$
$I_{pk}$
$I_{max}$
$I_{dmin}$
$K_v$
$K_i$
$I_{sol}$
$V_{bat}$
Sol
$V_d, V_{sol}$
E
W
$I_d$
$V_{con}$
F
I
$V_{ST}$
Temp
ST
MC
T
S4
S3
S1
S2
V(d/dt)
$a_{gr}$
$a_{kl}$
$s_{gr}$
$s_{kl}$

METHOD AND APPARATUS FOR TRIGGERING AN ELECTROMAGNETIC CONSUMER

BACKGROUND OF THE INVENTION

Field of the Invention

The invention relates to a method for triggering a power end stage for an electromagnetic consumer connected in series with the power end stage, in particular for a magnet valve of a Diesel injection pump of an internal combustion engine, through the use of a high turn-on current and then a low holding current that is regulated to a predetermined value, having timing control and having a free-running voltage that can be switched over.

The invention also relates to an apparatus for triggering a power end stage for an electromagnetic consumer, in particular a magnet valve for a Diesel injection pump in an internal combustion engine, which is connected in series with the consumer to a supply voltage, having a free-running circuit that can be switched over from low to high free-running voltage and having a timing control circuit.

In many applications, especially in automotive engineering, magnet valves are needed that can switch high pressures within short, close-tolerance times. In order to provide electronic control of Diesel engines, for instance, such valves are needed so as to achieve reduced fuel consumption and better exhaust gas figures. Exact adherence to the onset and duration of injection is absolutely indispensable. Moreover, especially when the turn-on time of the magnet valve is long (several milliseconds), the power loss in the magnet coil or solenoid must be kept as low as possible, and electromagnetic interference voltage originating in the system including the electronics and the solenoid must be limited to the values required.

Fast-switching magnet valves with a long turn-on time are triggered in three phases:

- during the turn-on phase, the highest possible voltage is applied to the solenoid (magnetization), to enable the fastest possible buildup of a high current and therefore an adequate magnetic field for fast attraction of the armature;
- in the holding phase, the current is regulated to a predetermined value, thus limiting the power loss in the coil; and
- in the turn-off phase, a major negative voltage is applied to the solenoid (demagnetization), to enable a rapid discharge of the stored current so that the armature will decrease quickly.

Two basic variants for triggering fast-switching magnet valves are known.

In a first variant, a high voltage (about 100 V) is generated and is applied to the solenoid during the turn-on phase. After the valve opens, a substantially lower voltage (about 12 V) suffices to keep the magnet valve open in the holding phase. The effort and expense of generating the high voltage and storing enough energy for the turn-on phase are a disadvantage. Electrolyte capacitors cause a significant limitation in the allowable temperature and significantly shorten the service life, while foil or film capacitors are very large and expensive.

In a second variant, a solenoid with low internal resistance is used, so that fast switching is possible even at reduced voltage (such as 12 V). Once again, in that variant as well, the holding current through the solenoid during the holding phase must be limited. That is carried out either by analog regulation of the holding current (slight electromagnetic interference, but large power loss at longer turn-on times) or by switched regulation, which makes a pulse width modulated coil voltage available and thus produces a substantially smaller power loss as compared with analog regulation. However, especially on the supply lines, major electromagnetic interference appears because of the rapid current changes.

Electrolyte capacitors used as buffer energy stores for interference suppression are not very suitable, because of the wide ambient temperature range, high frequencies (steep switching signal edges), and high currents.

An electromagnetic fuel injection valve of the type described above is known from German Published, Non-Prosecuted Patent Application DE-OS 28 28 678.

Summary of the Invention

It is accordingly an object of the invention to provide a method and an apparatus for triggering an electromagnetic consumer, which overcome the hereinafore-mentioned disadvantages of the heretofore-known methods and devices of this general type, which do not use storage capacitors and in which power loss and electromagnetic interference voltages on supply lines can be kept low.

With the foregoing and other objects in view there is provided, in accordance with the invention, a method for triggering a power end stage for an electromagnetic consumer connected in series with the power end stage, in particular for a magnet valve of a Diesel injection pump of an internal combustion engine, through the use of a high turn-on current and then a low holding current being regulated to a predetermined value, having timing control and having a free-running voltage to be switched over, which comprises when the consumer is turned on, increasing a control voltage from a zero value at a constant, high rate of increase until a voltage above the end stage has attained a predetermined value and a magnetization phase begins; during magnetization phases in which the current through the end stage is equal to the current through the consumer, regulating the voltage at the end stage with the control voltage to a predetermined value until a current through the end stage or through the consumer attains a predetermined maximum value; after each attainment of a maximum value of the turn-on current or of a holding current, until the consumer is turned off, repeatedly reducing the control voltage during a predetermined time period at a constant, low rate of decrease, until the current through the end stage has attained a predetermined value, then keeping the control voltage constant at the predetermined value until the end of the predetermined time period, and then, after the end of the predetermined time period, raising the control voltage at a constant, slight rate of increase, until the current through the end stage attains a predetermined value, or becomes equal to the current through the consumer, whereupon a magnetization phase ensues, until the current attains the predetermined value; and when the consumer is turned off, upon the switchover of the free-running voltage to a higher value, reducing the control voltage down to a zero value at a constant, high rate of decrease.

In accordance with another mode of the invention, there is provided a method which comprises regulating an interference voltage on supply lines to a predetermined value by controlling the rate of increase and decrease of the control voltage as a function of a temperature of the end stage.

In accordance with a further mode of the invention, there is provided a method which comprises regulating a coil voltage to a predetermined value, until the maximum turn-on current is attained.

With the objects of the invention in view there is also provided an apparatus for triggering a power end stage for an electromagnetic consumer, in particular for a magnet valve for a Diesel injection pump in an internal combustion engine, connected in series with the consumer to a supply voltage, comprising a free-running circuit connected to the consumer for switching over from low to high free-running voltage; a timing control circuit; an integrator having an input and having an output connected to the end stage for supplying an output voltage as a control voltage for the end stage; at least one small and one large current source and one small and one large current sink supplying output currents; switches connected between the current sources and current sinks and the input of the integrator, for delivering the output currents of the current sources and current sinks to the input of the integrator for rapidly and slowly charging and discharging the integrator; and a control circuit connected to the switches, connected to the free-running circuit and associated with the timing control circuit, for actuating the switches and a switchover of the free-running circuit as a function of a control signal, of certain values of a voltage applied to the end stage or to the consumer, and of certain values of a current, $I_{sol}$) flowing through the end stage or the consumer, and of the timing control circuit specifying a certain time period.

In accordance with a concomitant feature of the invention, the control circuit is a microcontroller into which the timing control circuit is integrated.

Other features which are considered as characteristic for the invention are set forth in the appended claims.

Although the invention is illustrated and described herein as embodied in a method and an apparatus for triggering an electromagnetic consumer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
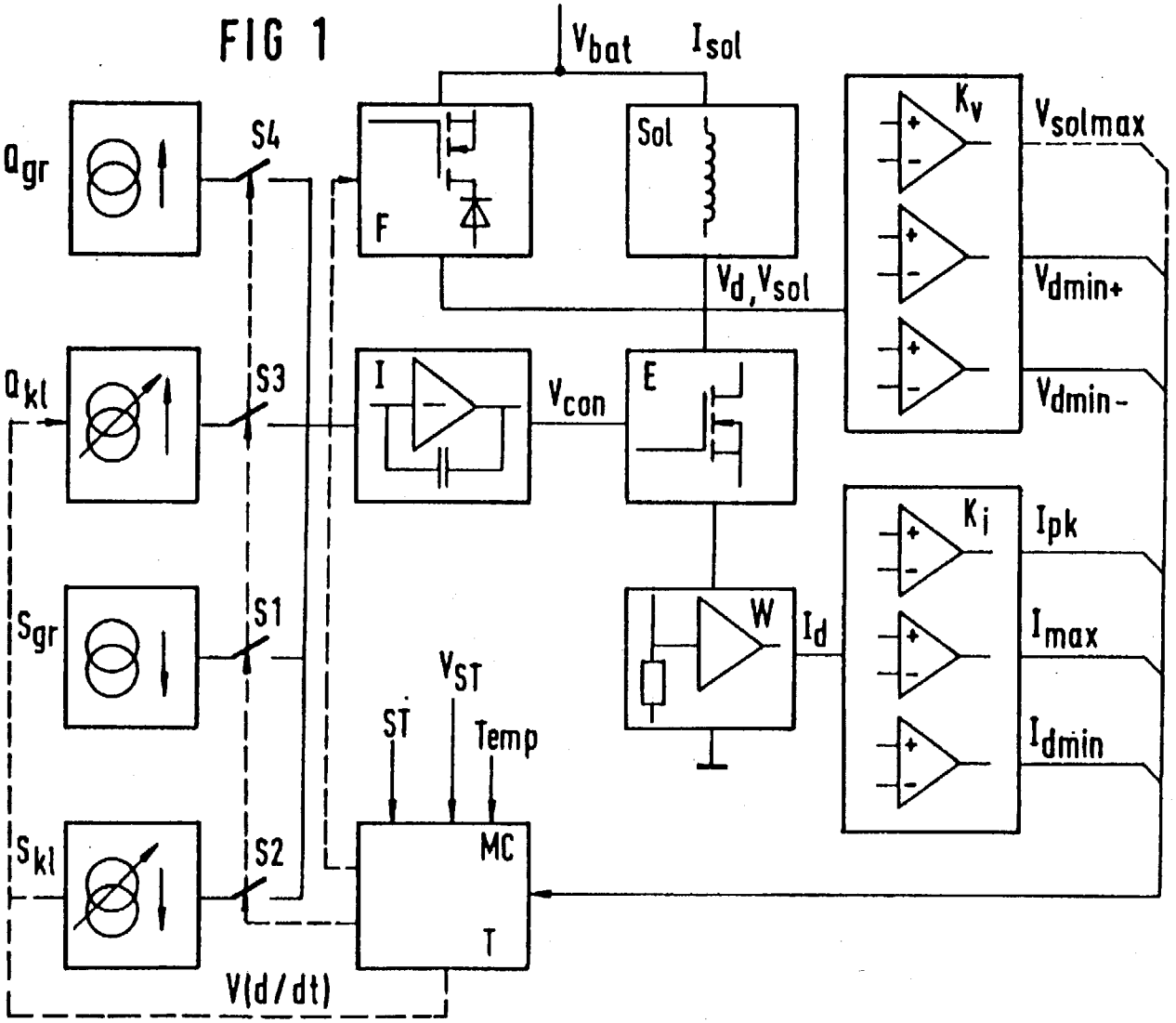
FIG. 1 is a block circuit diagram of a power end stage according to the invention.

Referring now to the figures of the drawings in detail and first, particularly, to FIG. 1 thereof, there is seen a block circuit diagram of a power end stage E which is controlled by a microcontroller MC and operated at a supply voltage $V_{bat}$ for triggering a magnet valve for a Diesel injection pump of an internal combustion engine.

An integrator I, which inverts in this exemplary embodiment, furnishes a control voltage $V_{con}$ for the end stage E, which has at least one bipolar or MOSFET transistor. The integrator I can be charged through two current sinks $S_{gr}$ and $S_{kl}$ (which respectively cause the control voltage $V_{con}$ to increase quickly or slowly) or discharged through two current sources $Q_{gr}$ and $Q_{kl}$ (respectively causing the control voltage $V_{con}$ to decrease quickly or slowly), through the use of switches S1–S4 which are regulated by the microcontroller MC. As the control voltage $V_{con}$ rises, a current $I_d$ through the end stage E increases.

A consumer in the form of a solenoid Sol is connected to a reversible free-running circuit F, which when the consumer or sink is turned on (turn-on signal St=H) can take over a current $I_{sol}$ through the solenoid Sol with the least voltage drop, and when the consumer is turned off (turn-on signal St=L) is switched over to the highest possible free-running voltage, that is dependent on limit values of the components being used, to enable reducing the current through the solenoid as quickly as possible.

In this exemplary embodiment, a voltage $V_d$ above the end stage E and the current $I_d$ through the end stage, which is converted into a voltage by a current-to-voltage converter W, are compared through the use of respective comparators $K_v$ and $K_i$ with threshold values $V_{dmin+}$, $V_{dmin-}$, $I_{pk}$, $i_{Hmax}$, and $I_{dmin}$. These values will be explained later herein. Output signals of these comparators are supplied to the microcontroller MC, which controls a process sequence of the power end stage E on the basis of these signals. The microcontroller MC includes a timer, timing control or timing control circuit T, which assures a correct free-running time $t_{off}$ and thus an adequate minimal holding current $I_{Hmin}$ through the solenoid Sol. A voltage $V_{sol}$ above the solenoid can be monitored in addition (through threshold values $V_{solmax+}$ and $V_{solmax-}$) or alternatively to the voltage $V_d$.

If the supply voltage $V_{bat}$ is high, then a maximum turn-on current ipk might be attained before the valve switches mechanically. In that case, detection of the switching of the valve by detecting a change in the current increase can no longer be carried out.

In order to remedy this problem, the voltage $V_{sol}$ above the solenoid Sol can be measured and limited by regulation to the maximum value $V_{solmax}$. Thus, the current increase through the solenoid is limited beyond a certain magnitude of the supply voltage.

Since all of the component groups in the block circuit diagram described above are known per se, a detailed circuit diagram can be dispensed with.

Figure 2:
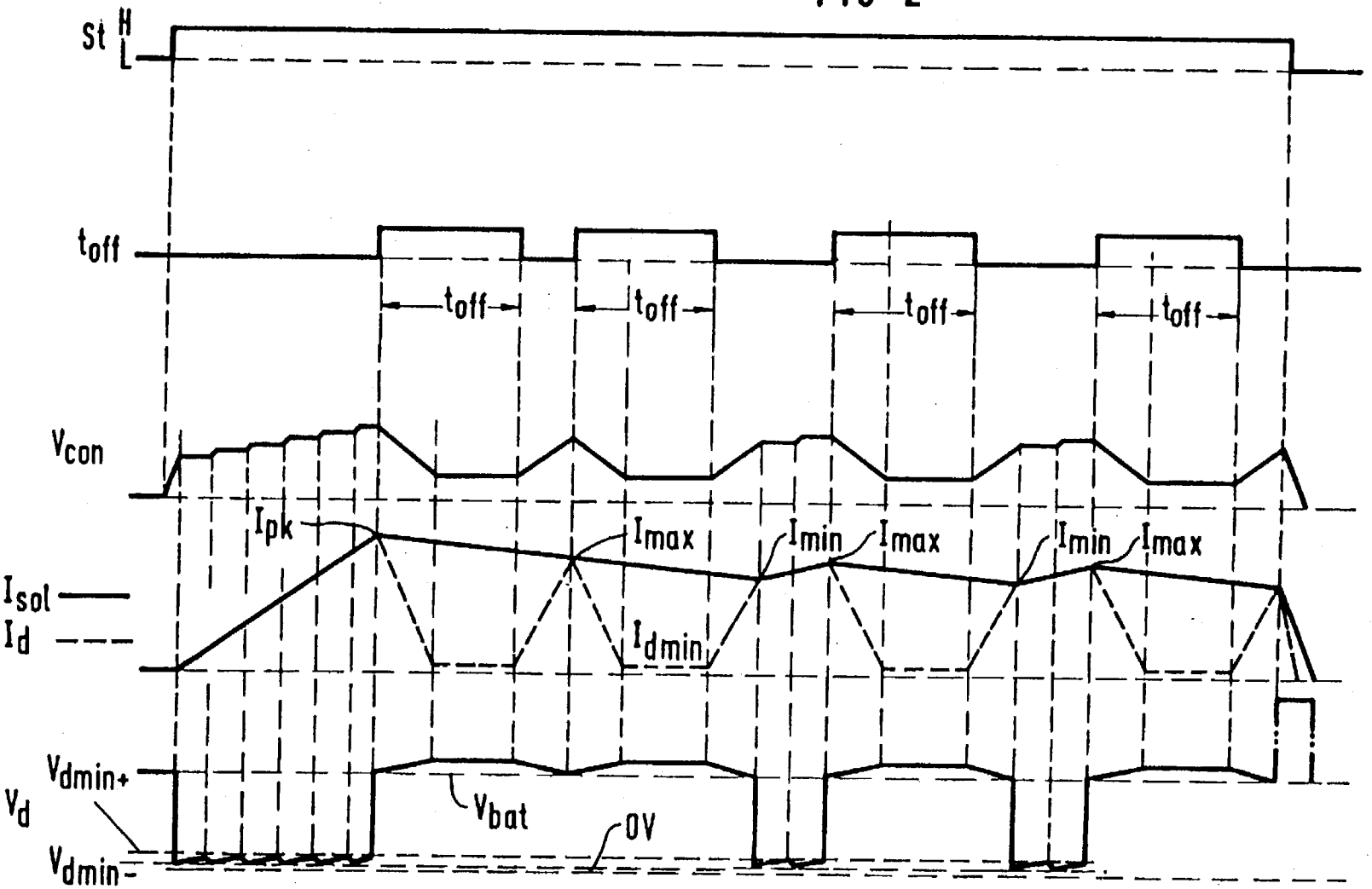
FIG. 2 is a graph of signals of the power end stage.
Figure 3A:
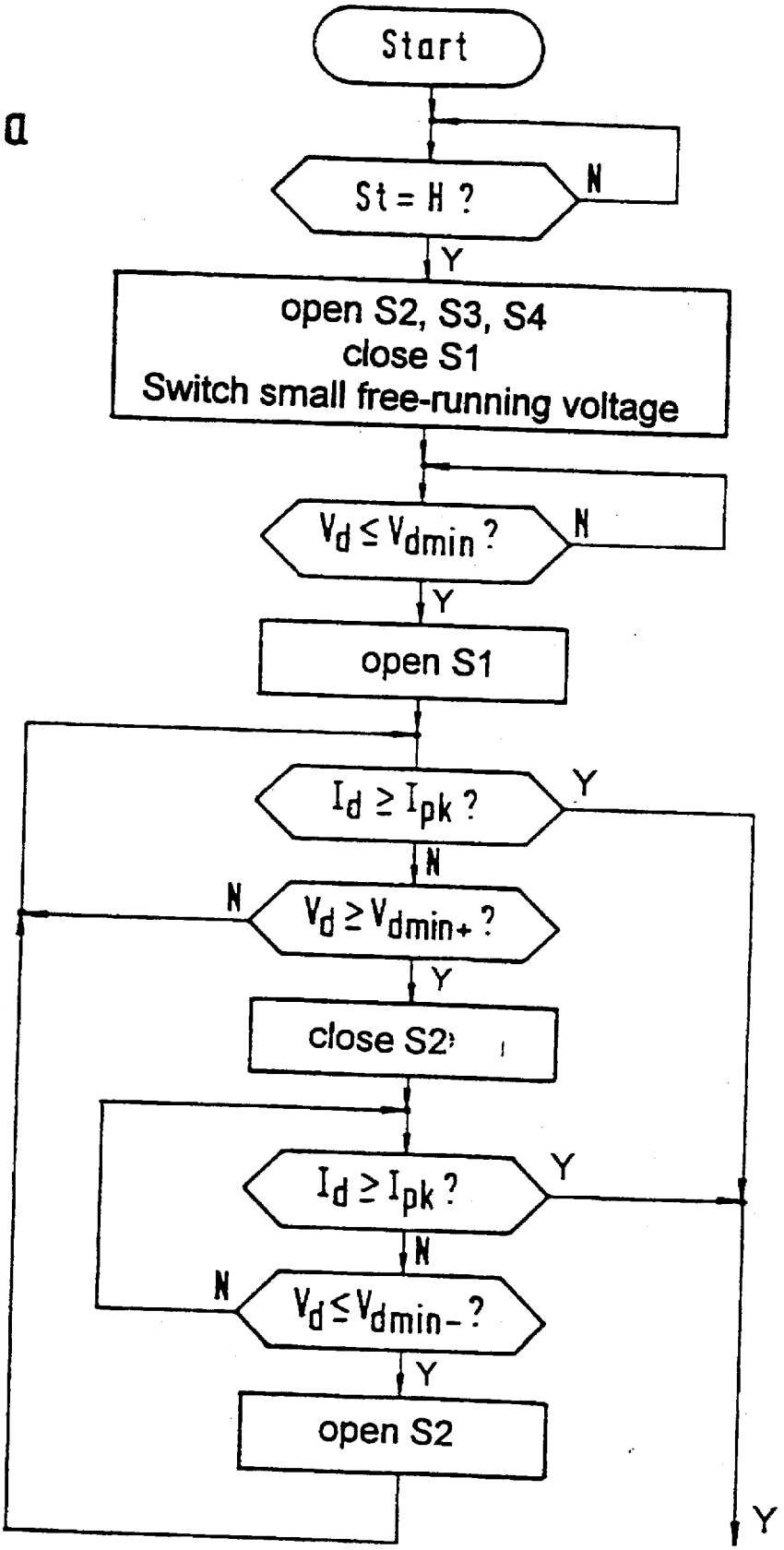
FIGS. 3*a* and 3*b* together are a flow chart showing a process sequence in the operation of the power end stage.
Figure 3B:
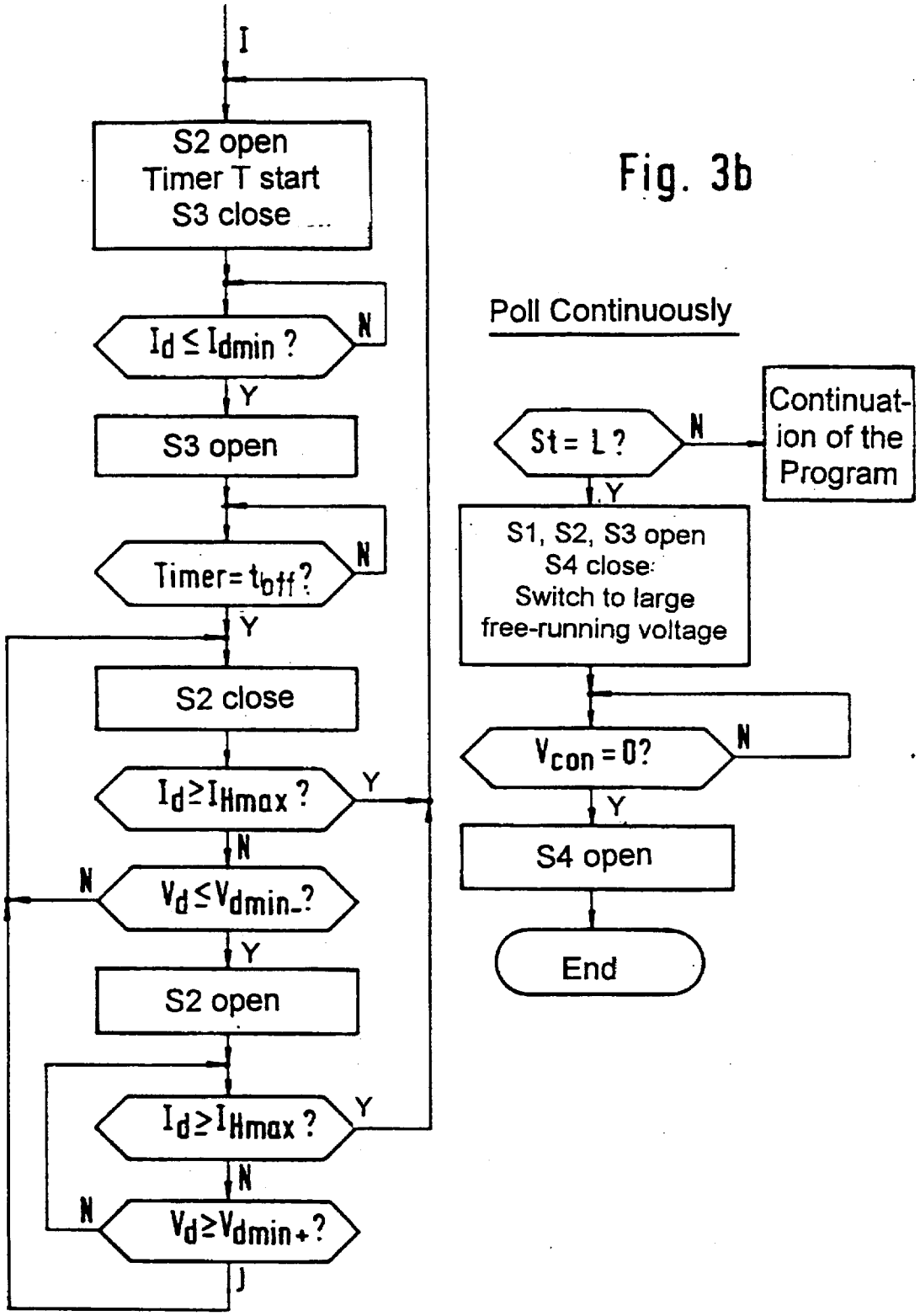

The control process that unfolds in this apparatus will be described in detail below through the use of FIGS. 2, 3*a* and 3*b*, which will mostly be referred to together.

With the valve off, the switches S1–S4 are opened, and the end stage E is nonconducting. Upon the turn-on signal St=H, the microcontroller MC closes the switch S1. As a result, the large current sink $S_{gr}$ is applied to the input of the integrator I, causing its output voltage, which is the control voltage $V_{con}$ of the end stage E, to rise rapidly from the zero value at a constant, high rate of increase $+dV_{con1}/dt$, until when a non-illustrated threshold voltage of the end stage is attained the end stage becomes conducting, and consequently the voltage $V_d$ at the end stage E drops rapidly. The current $I_d$ begins to flow through the end stage E (and through the solenoid Sol), as is seen in FIG. 2.

As soon as the voltage $V_d$ at the end stage E has dropped to a predetermined value $V_{dmin-}$, which is reported to the microcontroller MC by the comparator $K_v$, the microcontroller opens the switch S1 and then regulates the voltage $V_d$ to a predetermined, constant value $V_{dmin}$ (with hysteresis between $V_{dmin-}$ and $V_{dmin+}$), until the current $I_d=I_{sol}$ (magnetization phase) through the solenoid and the end stage, which increases even more, attains a predetermined peak valve $I_{pk}$.

To that end, the switch S2 is closed (the small current sink $S_{kl}$ is applied to the input of the integrator I) if the voltage $V_d$ is higher than a predetermined threshold value $V_{dmin-}$ (causing the control voltage $V_{con}$ to increase slowly and the voltage $V_d$ to decrease), and opened if the control voltage $V_d$ is less than or equal to the threshold value $V_{dmin-}$, as a result of which (if all of the switches are open) the control voltage $V_{con}$ remains constant, while the current $I_d$ through the end stage and the current through the solenoid Sol ($I_d=I_{sol}$) and therefore the voltage $V_d$ at the end stage increase slowly, until the control voltage $V_d$ at the end stage attains or exceeds the second specified threshold value $V_{dmin+}$. The switch S2 is then closed again (the small current sink $S_{kl}$ is applied to the input of the integrator I), and so forth, until the peak value $I_{pk}$ is attained. Thus both a magnetization phase and the turn-on phase (flow chart in FIG. 3*a*) are ended, and the holding phase begins (left-hand flow chart in FIG. 3*b*).

A switched regulation of this kind, with a predetermined rate of current increase, leads to predeterminable interference voltages that are substantially less than in a pure switching controller, without producing the power loss of an analog controller.

If the full current flows through the end stage, the current increase is no longer determined by the control voltage, but instead it is determined substantially by the coil inductance L and the supply voltage $V_{bat}$ ($di/dt=V_{bat}/L$). The end stage goes into saturation, and the integrator is charged too strongly. If a turn-off command then comes, the integrator then first has to be freed of its excessive charge, before the current can decrease. If this discharging is too slow, the idle time and therefore the turn-off time of the valve become too long. If the discharging is fast, the transition to the active range causes a forceful change in current, and attendant strong interference voltages on the supply lines. Regulating the voltage above the end stage prevents saturation, and the charge of the integrator is exactly equivalent to the current through the end stage. An immediate current change is thus possible at any time, and only slight interference voltages appear on the supply lines. Scattering in the turn-off times of the valve thus remains slight, and is independent of the state of the switchgear at that time.

At the moment when the current $I_d$ through the end stage E (which equals the current $I_{sol}$ through the solenoid Sol) attains the turn-on peak value $I_{pk}$, a switchover is made to holding-current regulation, in which the current $I_{sol}$ is held between the values $I_{Hmax}$ and $I_{Hmin}$. The switch S2 is opened, and the microcontroller MC starts the timer T, which specifies a time period $t_{off}$. At the same time, the switch S2 is closed, and as a result the small current source $Q_{kl}$ is applied to the input of the integrator I. As a result, the control voltage $V_{con}$ is lowered, at a constant, slight rate of decrease $-dV_{con2}/dt$, until the resultant, also-decreasing current $I_d$ (shown in dashed lines in FIG. 2) attains the specified value $I_{dmin}$.

End stages with bipolar or power MOS transistors need a certain threshold voltage before the output current changes. This threshold voltage is dependent on the particular equipment and on the temperature and leads to an idle time in which the charge of the integrator has to be changed before any change in current can take place. The consequence thereof is that the difference between the maximum and minimum holding current becomes too great, making the switching times of the valve excessively variable. The current $I_d$ through the end stage is thus not dropped down to the value of zero but instead is kept constant at a detectable minimum level $I_{dmin}$, by turning off all of the current sources and current sinks of the integrator.

As soon as the current $I_d$ has attained the predetermined value $I_{dmin}$, then by opening of the switch S3 it is kept constant at this value until the end of the period $t_{off}$. The remaining current $I_{sol}$ through the solenoid Sol that does not flow through the end stage E is taken over by the free-running circuit F. The current through the solenoid Sol decreases slowly, because of losses in the coil and in the free-running circuit.

Once the time period $t_{off}$ has elapsed, the switch S2 is closed again, and as a result the small current sink $S_{kl}$ is applied to the input of the integrator I, and the control voltage $V_{con}$ increases slowly again (and with it the current $I_d$ as well) at a constant rate of increase $+dV_{con2}/dt$, until a) $I_d=I_{sol}<I_{Hmax}$, or b) $I_d=I_{sol}=I_{Hmax}$, or c) $I_d=I_{Hmax}$ and $I_{sol}>I_{Hmax}$.

In case a), the voltage $V_d$ at the end stage, which from the time the current value $I_{pk}$ was attained has been greater than or equal to the supply voltage $V_{bat}$, drops suddenly as soon as the full coil current $I_{sol}$ flows through the end stage E. If the voltage $V_d$ becomes less than the threshold value $V_{dmin-}$, then the voltage $V_d$ at the end stage E is again regulated to the value $V_{dmin}$ (see turn-on phase) until such time as the current $I_d$ through the end stage E has attained the threshold value $I_{Hmax}$ (the value of the maximum holding current).

In all three cases, when the threshold value $I_{Hmax}$ is attained, a new time period $t_{off}$ is started, and the process is repeated from the time the current value $I_{pk}$ is attained, as described above. Not only the rates of increase and decrease $\pm dV_{con2}/dt$ of the control voltage $V_{con}$ but also the time period $t_{off}$ must be adapted by calibration to one another in such a way that, during the time while the control voltage $V_{con}$ drops, while it is kept constant and while it is raised again until $I_d=I_{sol}$, the current $I_{sol}$ through the solenoid Sol decreases no further from the specified value $I_{Hmax}$ of the holding current than down to a minimum required value $I_{Hmin}$.

Decreasing the control voltage $V_{con}$, keeping it constant, and raising it again, and optionally regulating the voltage $V_d$, are repeated until the consumer Sol is turned off (control signal St=L). The state of the control voltage St is therefore polled continuously by the microcontroller MC. In the turn-off phase (right-hand flow chart in FIG. 3*b*), the switches S1–S3 are opened and the switch S4 is closed. As a result, the large current source $Q_{gr}$ is applied to the input of the integrator I, and consequently the control voltage $V_{con}$ is lowered to the value of zero at a constant, high rate of decrease $-dV_{con1}/dt$, and the end stage E passes over to the nonconducting state as a result. At the same time, the free-running circuit F is switched over to the high free-running value, causing the current $I_{sol}$ through the solenoid to fade rapidly.

The interference voltages on the supply lines are dependent on the inductance of the line and on the rate of change in the currents flowing through them. Detecting these interference variables $V_{st}$ and the temperature Temp of the end stage (shown in FIG. 1 as inputs of the microcontroller MC), and controlling the rates of current increase and decrease in a way associated with these values, enable regulation of the allowable interference voltages without thermally overloading the end stage. To that end, the small current source $Q_{kl}$ and the small current sink $S_{kl}$ must be respectively constructed as a controllable current source and current sink which is suggested in FIG. 1 by the dashed lines connecting the microcontroller MC and the small current source $Q_{kl}$ and the small current sink $S_{kl}$.

In a power end stage E with an analog controller, instead of the switching controller described, the small controlled current sink $S_{kl}$ is changed in its output current directly by the voltage $V_d$ above the end stage E, or in the turn-on phase (until the turn-on peak value $I_{pk}$ is attained) by the voltage $V_{sol}$ above the solenoid Sol as well, in such a way that the required threshold values $V_{dmin}$ or $V_{solmax}$ are adhered to. Then the waviness of the voltage $V_d$ or $V_{sol}$, which is unavoidable in switched regulation, disappears. However, there can be stability problems in such an embodiment.

We claim:

1. In an apparatus for triggering a power end stage for a magnet valve for a Diesel injection pump in an internal combustion engine, connected in series with the magnet valve to a supply voltage, the improvement comprising:

a free-running circuit connected to the magnet valve for switching over from low to high free-running voltage;

a timing control circuit;

an integrator having an input and having an output connected to the end stage for supplying an output voltage as a control voltage for the end stage;

at least one small and one large current source and one small and one large current sink supplying output currents;

switches connected between said current sources and current sinks and said input of said integrator, for delivering the output currents of said current sources and current sinks to said input of said integrator for rapidly and slowly charging and discharging said integrator; and a control circuit connected to said switches, connected to said free-running circuit and associated with said timing control circuit, for actuating said switches and a switchover of said free-running circuit as a function of a control signal, of certain values of a voltage applied to the end stage or to the magnet valve, and of certain values of a current flowing through the end stage or the magnet valve, and of said timing control circuit specifying a certain time period.

2. In a method for triggering a power end stage for an electromagnetic consumer connected in series with the power end stage, through the use of a high turn-on current and then a low holding current being regulated to a predetermined value, having timing control and having a free-running voltage to be switched over, the improvement which comprises:

when the consumer is turned on, increasing a control voltage from a zero value at a constant, high rate of increase until a voltage above the end stage has attained a predetermined value and a magnetization phase begins;

during magnetization phases in which the current through the end stage is equal to the current through the consumer, regulating the voltage at the end stage with the control voltage to a predetermined value until a current through the end stage or through the consumer attains a predetermined maximum value;

after each attainment of a maximum value of the turn-on current or of a holding current, until the consumer is turned off, repeatedly:

a) reducing the control voltage during a predetermined time period at a constant, low rate of decrease, until the current through the end stage has attained a predetermined value, b) then keeping the control voltage constant at the predetermined value until the end of the predetermined time period, and c) then, after the end of the predetermined time period, raising the control voltage at a constant, slight rate of increase, until the current through the end stage:

c1) attains a predetermined value, or c2) becomes equal to the current through the consumer, whereupon a magnetization phase ensues, until the current attains the predetermined value; and when the consumer is turned off, upon the switchover of the free-running voltage to a higher value, reducing the control voltage down to a zero value at a constant, high rate of decrease.

3. The method according to claim 2, which comprises regulating an interference voltage on supply lines to a predetermined value by controlling the rate of increase and decrease of the control voltage as a function of a temperature of the end stage.

4. The method according to claim 2, which comprises regulating a coil voltage to a predetermined value, until the maximum turn-on current is attained.

5. In a method for triggering a power end stage for a magnet valve of a Diesel injection pump of an internal combustion engine connected in series with the power end stage, through the use of a high turn-on current and then a low holding current being regulated to a predetermined value, having timing control and having a free-running voltage to be switched over, the improvement which comprises:

when the magnet valve is turned on, increasing a control voltage from a zero value at a constant, high rate of increase until a voltage above the end stage has attained a predetermined value and a magnetization phase begins;

during magnetization phases in which the current through the end stage is equal to the current through the magnet valve, regulating the voltage at the end stage with the control voltage to a predetermined value until a current through the end stage or through the magnet valve attains a predetermined maximum value;

after each attainment of a maximum value of the turn-on current or of a holding current, until the magnet valve is turned off, repeatedly:

a) reducing the control voltage during a predetermined time period at a constant, low rate of decrease, until the current through the end stage has attained a predetermined value, b) then keeping the control voltage constant at the predetermined value until the end of the predetermined time period, and c) then, after the end of the predetermined time period, raising the control voltage at a constant, slight rate of increase, until the current through the end stage:

c1) attains a predetermined value, or c2) becomes equal to the current through the magnet valve, whereupon a magnetization phase ensues, until the current attains the predetermined value; and when the magnet valve is turned off, upon the switchover of the free-running voltage to a higher value, reducing the control voltage down to a zero value at a constant, high rate of decrease.

6. In an apparatus for triggering a power end stage for an electromagnetic consumer connected in series with the consumer to a supply voltage, the improvement comprising:

a free-running circuit connected to the consumer for switching over from low to high free-running voltage;

a timing control circuit;

an integrator having an input and having an output connected to the end stage for supplying an output voltage as a control voltage for the end stage;

at least one small and one large current source and one small and one large current sink supplying output currents;

switches connected between said current sources and current sinks and said input of said integrator, for delivering the output currents of said current sources and current sinks to said input of said integrator for rapidly and slowly charging and discharging said integrator; and a control circuit connected to said switches, connected to said free-running circuit and associated with said timing control circuit, for actuating said switches and a switchover of said free-running circuit as a function of a control signal, of certain values of a voltage applied to the end stage or to the consumer, and of certain values of a current, $I_{sol}$) flowing through the end stage or the consumer, and of said timing control circuit specifying a certain time period.

7. The apparatus according to claim 6, wherein said control circuit is a microcontroller into which said timing control circuit is integrated.

* * * * *